US007159491B1

(12) United States Patent
Chaconas et al.

(10) Patent No.: US 7,159,491 B1
(45) Date of Patent: Jan. 9, 2007

(54) OIL DRAIN PLUG SOCKET FOR A WRENCH ASSEMBLY

(75) Inventors: Peter C. Chaconas, Glyndon, MD (US); Paul S. Steinweg, Litiz, PA (US)

(73) Assignee: Easco Hand Tools, Inc., Simsbury, CT (US)

( * ) Notice: Subject to any disclaimer, the term of this patent is extended or adjusted under 35 U.S.C. 154(b) by 0 days.

(21) Appl. No.: 11/220,467

(22) Filed: Sep. 7, 2005

(51) Int. Cl.
*B25B 23/16* (2006.01)

(52) U.S. Cl. ..... 81/58.1; 81/124.3; 81/177.85; 81/125

(58) Field of Classification Search ..... 81/124.3, 81/177.85, 125, 121.1, 58.1
See application file for complete search history.

(56) References Cited

U.S. PATENT DOCUMENTS

| | | | | |
|---|---|---|---|---|
| 3,392,767 | A * | 7/1968 | Stillwagon, Jr. | 81/451 |
| 4,663,998 | A * | 5/1987 | Parsons et al. | 81/125 |
| 4,800,786 | A | 1/1989 | Arnold et al. | 81/121.1 |
| 4,825,732 | A | 5/1989 | Arnold | 81/121.1 |
| 4,836,059 | A | 6/1989 | Arnold | 76/114 |
| 4,947,713 | A | 8/1990 | Arnold | 81/121.1 |
| 5,146,814 | A | 9/1992 | Vasichek | 81/125 |
| 5,199,334 | A | 4/1993 | Vasichek et al. | 81/125 |
| 5,277,088 | A | 1/1994 | Vasichek et al. | 81/125 |
| 5,295,422 | A * | 3/1994 | Chow | 81/124.3 |
| 5,542,320 | A | 8/1996 | Vasichek et al. | 81/125 |
| 6,006,630 | A | 12/1999 | Vasichek et al. | 81/125 |
| 6,761,093 | B1 * | 7/2004 | Chang | 81/121.1 |

* cited by examiner

*Primary Examiner*—Lee D. Wilson
*Assistant Examiner*—Anthony Ojini
(74) *Attorney, Agent, or Firm*—Nelson, Mullins, Riley & Scarborough, L.L.P.

(57) ABSTRACT

A ratchet wrench, the ratchet wrench having a head portion defining a substantially cylindrical inner engaging surface and a plurality of ribs extending radially inward therefrom. The socket includes a first portion defining a plurality of depressions axially aligned with the longitudinal axis in an outer surface thereof, the first portion being releasably received by the substantially cylindrical inner engaging surface, and a second portion including a cylindrical outer surface and defining a hexagonal recess therein. A grip ring includes a knurled outer surface and is disposed on the second portion outer surface. A magnetic insert is received in the hexagonal recess.

16 Claims, 6 Drawing Sheets

OIL DRAIN PLUG SOCKET FOR A WRENCH ASSEMBLY

FIELD OF THE INVENTION

The present invention relates generally to ratchet wrenches and their associated sockets. More particularly, the present invention relates to an oil drain plug socket for use with a wrench assembly.

BACKGROUND OF THE INVENTION

The present invention relates generally to ratcheting tools, and more particularly to a ratchet wrench that allows a user to easily remove an oil drain plug.

Changing the oil in a motorized vehicle requires removal of the oil drain plug so old oil can drain from the oil pan into a collection tank. In the case of businesses that specialize in fast oil change service, the oil is drained from the engine while it is still hot so that contaminants and impurities are carried out with the hot oil before having a chance to settle and cling to the bottom of the oil pan as the oil cools. Since the oil is hot, the oil plug is can be hot to the touch, making it difficult to remove. Once the oil is drained, the oil drain plug is replaced and new oil is added to the engine through an oil fill port.

Previously, the oil drain plug was removed using a variety of tools, such as an open end wrench, a fixed box end wrench, pliers, a ratcheting socket wrench or a ratcheting box end wrench. However, each tool is problematic. For example, use of open end and fixed box end wrenches can be slow because of the need to mount and dismount the wrench on the oil drain plug each time the wrench is indexed. Ratcheting wrenches are problematic because once the oil drain plug is broken loose, there may not be enough friction between the threads of the oil drain pan and the oil plug to allow the wrench to ratchet.

SUMMARY OF THE INVENTION

The present invention recognizes and addresses considerations of prior art constructions and methods. In one embodiment of the present invention, a ratchet wrench assembly includes a wrench having a handle and a head at one end of the handle, the head defining an opening. A ratchet ring is disposed in the opening such that the ratchet ring rotates with respect to the head in a first direction and rotates with the head in a second direction. The ratchet ring defines a substantially cylindrical inner engaging surface having at least one rib projecting radially inward therefrom. The assembly further includes a socket having a first portion with a cylindrical outer surface and defining a hexagonal recess, a grip ring non-rotatably disposed and axially fixed on the lower portion outer surface and extending radially therefrom, and a second portion. The second portion defines at least one depression in an outer surface thereof for releasably receiving the at least one ratchet ring rib therein when the barrel portion is inserted into the ratchet ring inner engaging surface.

Another embodiment of the invention includes a socket for use with a ratchet wrench, the ratchet wrench having a head portion defining a substantially cylindrical inner engaging surface and a plurality of ribs extending radially inward therefrom. The socket includes a longitudinal axis, a first portion defining a plurality of depressions axially aligned with the longitudinal axis in an outer surface thereof, the first portion being releasably received by the substantially cylindrical inner engaging surface, and a second portion including a cylindrical outer surface and defining a hexagonal recess therein. A grip ring includes a knurled outer surface and is disposed on the second portion outer surface. A magnetic insert is received in the hexagonal recess.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1A:
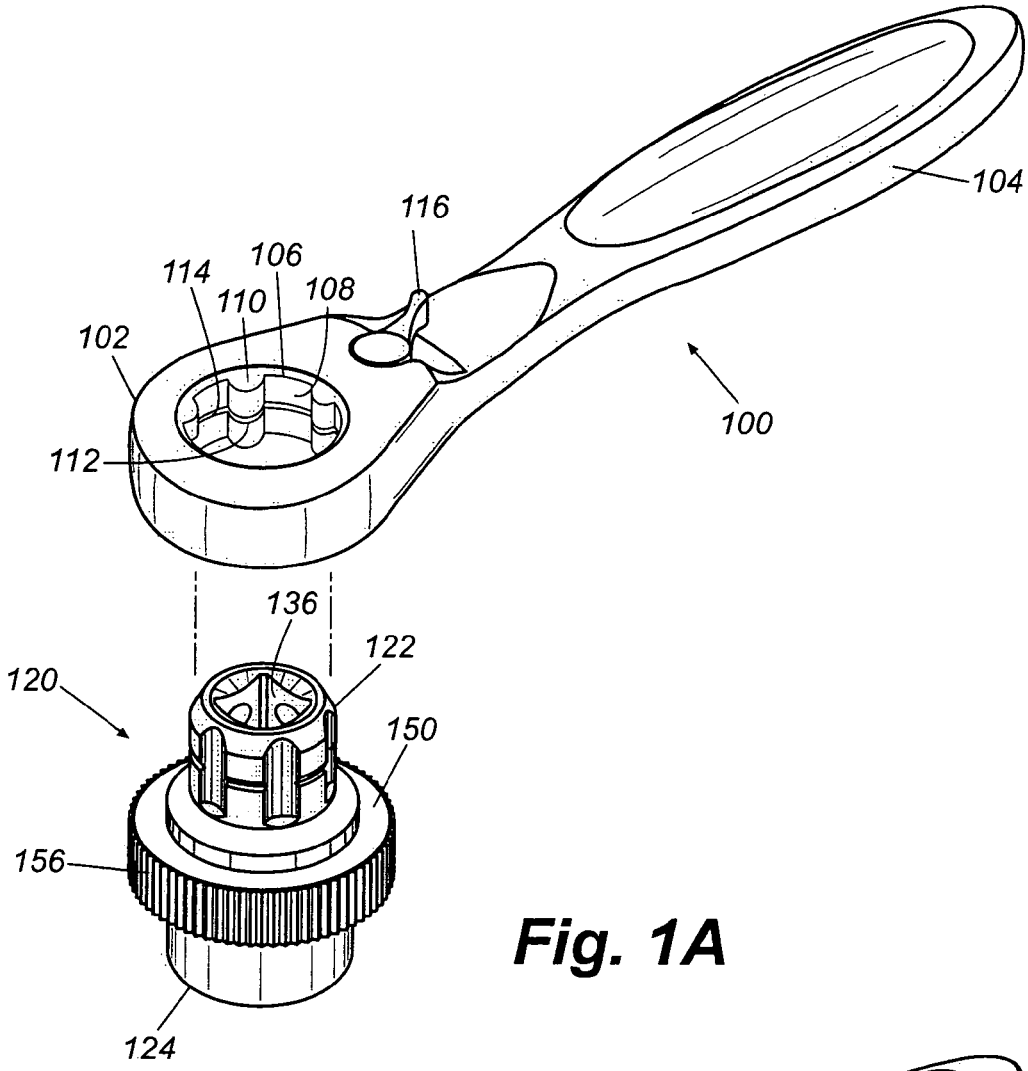
FIGS. 1A and 1B are perspective views of a wrench assembly including and oil drain plug socket in accordance with an embodiment of the present invention.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1B:
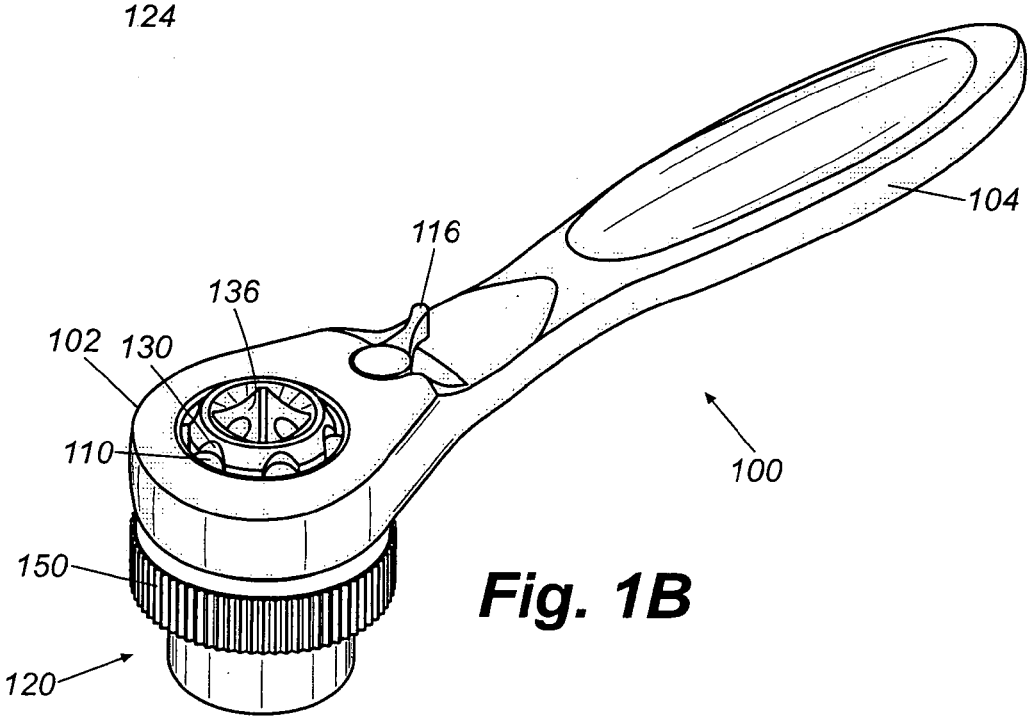

Referring to FIGS. 1A and 1B, a wrench assembly in accordance with the present invention includes a ratchet wrench 100 and an oil drain plug socket 120 (hereinafter plug socket). The ratchet wrench 100 includes a head portion 102 and a handle 104. A ratchet ring 106 rotatably received in head portion 102 includes an inner engaging surface 108 with a plurality of shaped ribs 110 extending inwardly therefrom. In one embodiment, the ribs are semi-cylindrically shaped. However, it should be understood that the ribs can be triangular, square, oval or any other suitable shape. Each rib 110 includes a slot, transverse to the axial direction of the ratchet ring, that align to form a first annular groove 112 configured to receive a ring 114. Ring 114 may be a continuous pliable ring or a discontinuous spring ring. Ribs 110 and ring 114 are received in corresponding depressions and slots, respectively, of a work piece, as discussed in greater detail herein.

Ratchet wrench 100 includes a lever 116 that allows a user to select the direction of rotation in which ratchet wrench 100 will apply torque to a work piece and the direction of rotation in which the wrench will ratchet about the workpiece. Lever 116 selectively controls a ratcheting mechanism (not shown) disposed within head portion 102 that engages an outer surface of ratchet ring 106. Embodiments of such ratchet mechanisms are disclosed in U.S. Pat. No. 6,918,323, to *Arnold et al.*, issued Jul. 19, 2005 and U.S. Pat. No. 5,295,422 to *Chow*, issued Mar. 22, 1994, the entire disclosures being incorporated by reference herein.

Figure 7:
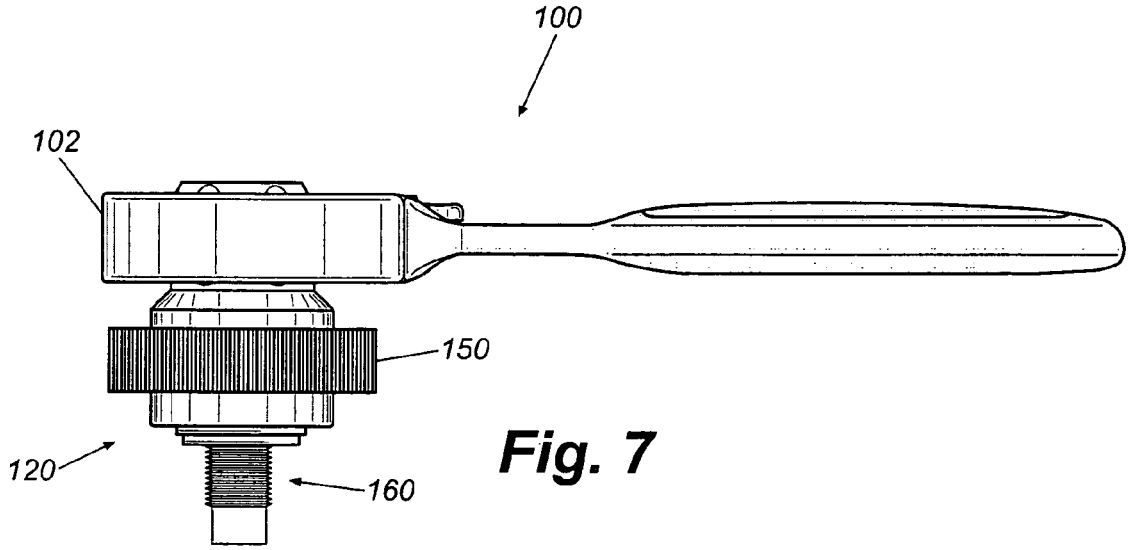
FIG. 7 is a side elevational view of the wrench assembly as shown in FIGS. 1A and 1B, including a drain plug socket therein.

Referring now to FIGS. 2A through 6, plug socket 120 includes a generally cylindrical rearward (or barrel) portion 122, a generally cylindrical forward portion 124 defining a recess 126, a magnetic insert 140 received in recess 126, and a disk-shaped grip ring 150 fixed to forward portion 124. In one embodiment, recess 126 is hexagonally shaped to receive a standard oil drain plug 160 (FIG. 7), but can have any desired shape (square, triangular, etc.) so as to receive drain plugs having non-standard configurations.

Figure 12:
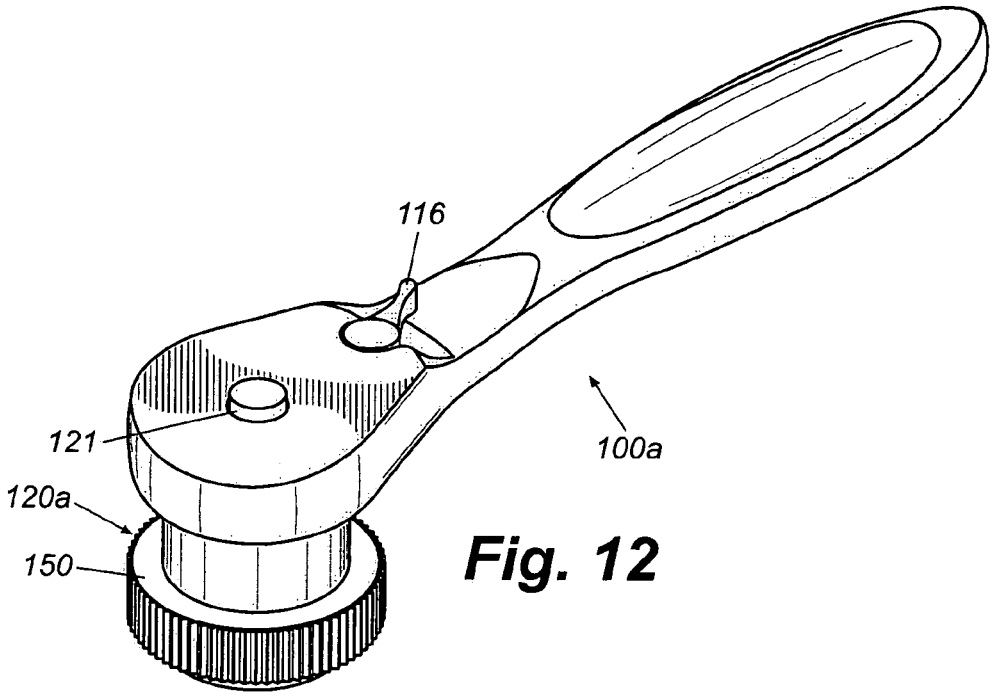
FIGS. 12 and 13 are perspective and side views, respectively, of a wrench assembly including the oil drain plug socket as shown in FIG. 10.
Figure 13:
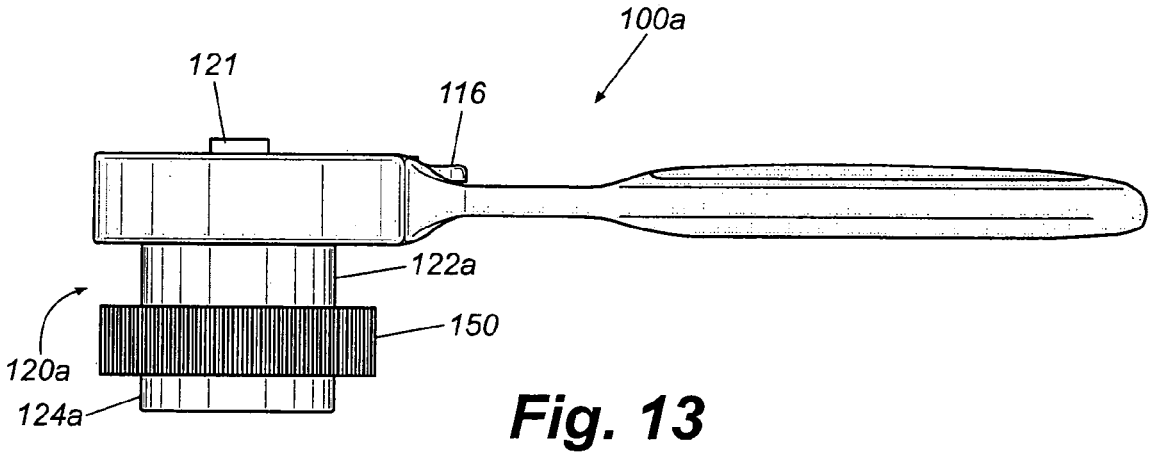

Barrel portion 122 includes a set of depressions 130 and a second annular groove 132. As shown, each depression 130 is semi-cylindrical in shape and spaced about barrel portion 122 so that the barrel portion is insertable into ratchet ring 106 (FIG. 1B). It should be understood that the shape of depressions 130 should correspond to the shape of ribs 110 so that barrel portion 130 is rotationally secured in ratchet ring 106. Second annular groove 132 is formed in an outer circumference of barrel portion 122 and aligns with first annular groove 112 when barrel portion 122 is inserted into ratchet ring 106. As such, second annular groove 132 is positioned to receive portions of ring 114 to releasably secure plug socket 120 in ratchet ring 106 in the axial direction, as shown in FIG. 1B. Barrel portion 122 also includes a square receiver 136 (FIGS. 1A and 1B) for receiving a shaped square drive tang (not shown) of a standard ratchet wrench (FIGS. 12 and 13). As such, plug socket 122 can be used with traditionally configured ratchet wrenches 100*a* (FIG. 12) as well as ratchet wrenches according to the present invention. Barrel portion 122 also includes an axial bore 134 for slidably receiving a portion of magnetic insert 140, as discussed below. A chamfered edge 123 aides in the insertion of barrel portion 122 into ratchet ring 106.

Figure 2A:
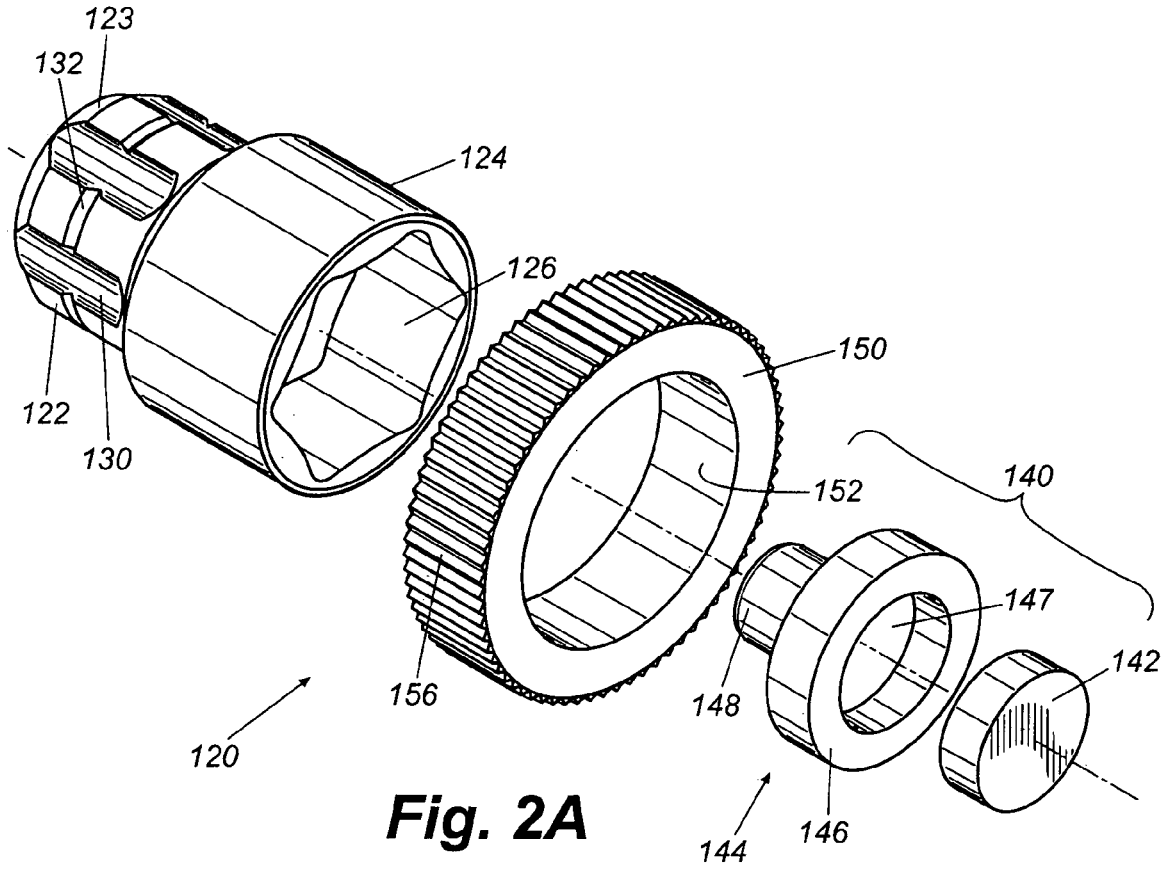
FIGS. 2A and 2B are perspective exploded and assembled views, respectively, of the oil drain plug socket as shown in FIGS. 1A and 1B.
Figure 2B:
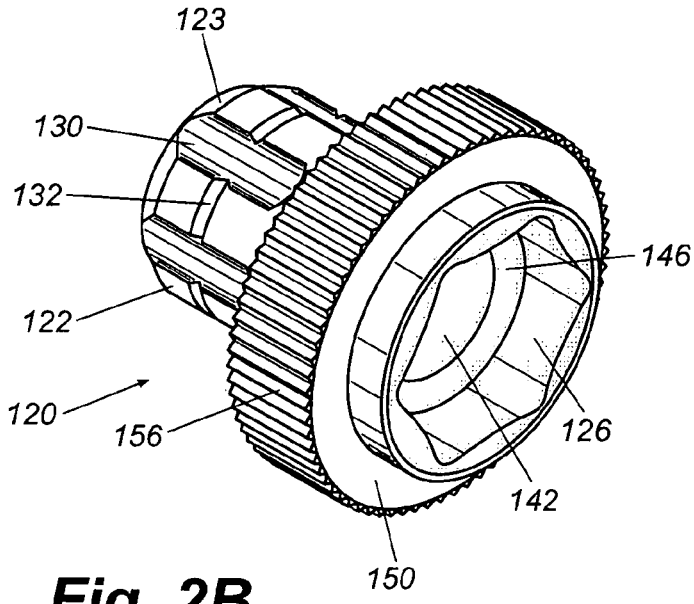
Figure 3:
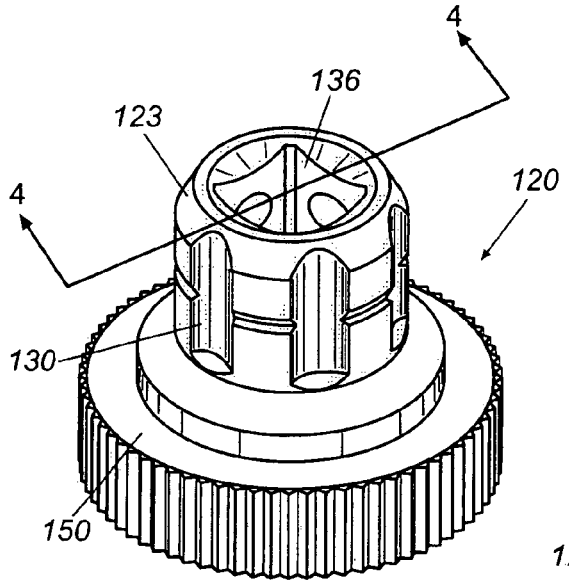
FIG. 3 is a perspective view of the oil drain plug socket as shown in FIG. 2B.
Figure 4:
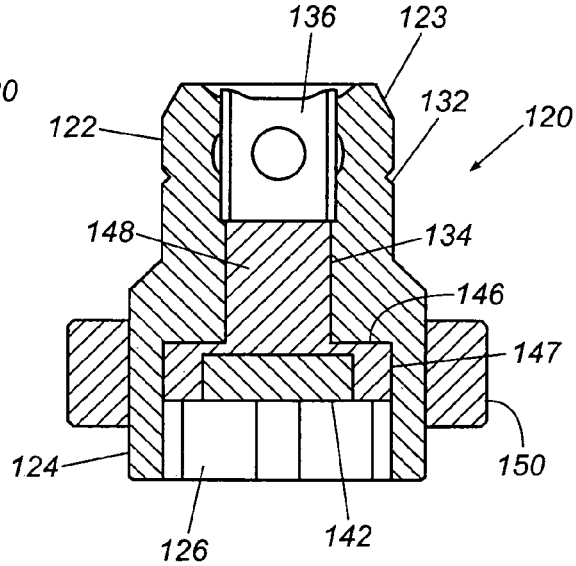
FIG. 4 is a cross-sectional side view of the oil drain plug socket as shown in FIG. 3, taken along line 4—4.
Figure 5:
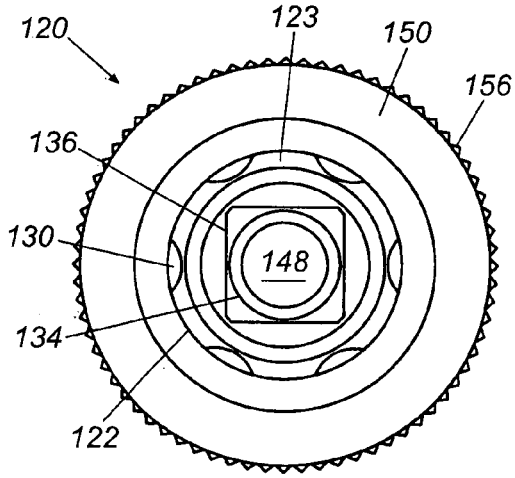
FIG. 5 is a top plan view of the oil drain plug socket as shown in FIG. 3.
Figure 6:
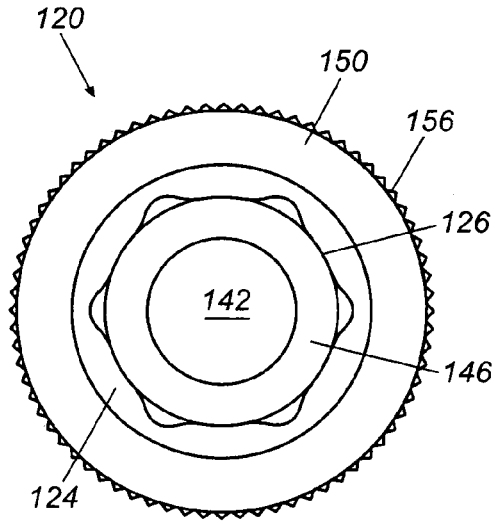
FIG. 6 is a bottom plan view of the oil drain plug socket as shown in FIG. 3.

Referring to FIG. 2A, magnetic insert 140 includes a magnetic element 142 housed in a plug 144. Preferably, plug 144 is molded from a suitable polymer, elastomer, or other material and includes a base portion 146 and a stem portion 148. Base portion 146 receives and retains magnetic element 142 in a recess 147 formed therein, and is configured to be slidably received in hexagonal recess 126 of socket forward portion 124. Similarly, stem portion 148 is configured to be slidably received in axial bore 134, as best seen in FIG. 4. Although magnetic element 142 is preferably secured in recess 147 by a press-fitting, a suitable adhesive may also be used to retain magnetic element 142 therein. Plug 144 is press-fitted into bore 134 but may also be retained in the bore by adhesive. Magnetic element 142 may be formed from either rare earth material or Ferrite.

The transverse cross-sectional shapes of base portion 146 and stem portion 148 need not be the same as the cross-sectional shapes of recess 126 and axial bore 134, respectively, to insure retention of magnetic insert 140 therein. Since plug 144 is preferably formed of an elastomeric material, plug 144 will conform slightly to recess 126 and axial bore 134, thereby retaining magnetic insert 140 in plug socket 120. However, alternate embodiments include plugs 144 in which the transverse cross-sections of base portion 146 and stem portion 148 are substantially similar to those of recess 126 and axial bore 134, respectively. As well, alternate embodiments also include a magnetic element 142 that is fully encapsulated within base portion 146.

Grip ring 150 is substantially disk-shaped and includes a central bore 152 configured to receive plug socket forward portion 124 through a press-fitting, thereby axially and rotatably fixing the grip disk to the plug socket. Preferably, grip ring 150 is constructed of anodized aluminum, although other metals, alloys, polymers and elastomer materials are suitable. As shown, grip ring 150 includes a knurled outer surface 156 to assist a user in manipulating the plug socket.

Grip ring 150 is preferably color-coded to assist a user in identifying the proper plug socket 120 for the desired application. For example, the plug socket for use on a 13 mm drain plug may have a red grip ring whereas the plug socket for use with a 14 mm drain plug may have a black grip ring. As well, although the outer diameter of each plug socket's forward portion is typically dependent on the size of the drain plug on which it is used, each grip ring preferably has the same outer diameter for ease of use.

In use, a user selects the proper size plug socket 120 that corresponds to the size of an oil drain plug 160 (FIG. 7) being removed. Next, the user typically secures plug socket 120 to wrench 100 by inserting barrel portion 122 into ratchet ring 106 prior to engaging the head of drain plug 160 with recess 126. However, the user may also first engage drain plug 160 with only plug socket 120, and subsequently secure wrench 100 to barrel portion 122. Preferably, magnetic element 142 exerts adequate magnetic force to maintain plug socket 120 in a suspended state from drain plug 160 without additional support from the user, thereby facilitating engagement of barrel portion 122 with wrench 100.

Figure 8:
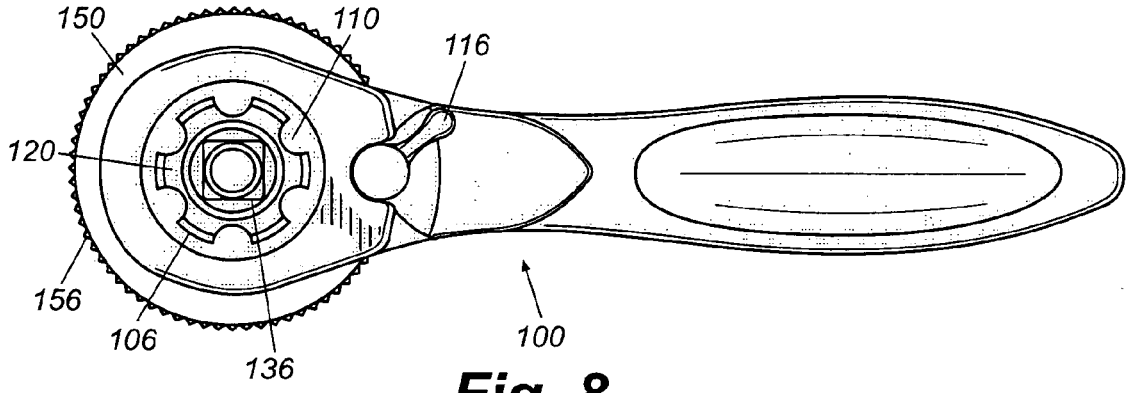
FIG. 8 is a top plan view of the wrench as shown in FIG. 7, including an alternate embodiment of an oil drain plug socket attached thereto.

Once the user has engaged drain plug 160 with plug socket 120, rotational force is exerted using wrench 100 to initially loosen drain plug 160. Once the drain plug is broken loose, the user grasps grip ring 150 and rotates it directly by hand where the friction between drain plug 160 and the oil drain pan is insufficient to allow wrench 100 to ratchet. Rotation of plug socket 120 via grip ring 150 may be accomplished either with the wrench removed from the plug socket or still engaged. Knurled outer surface 156 facilitates manipulation of grip ring 150 by the user. As best seen in FIG. 8, some embodiments of plug socket 120 include a grip ring 150 with an outer diameter that extends outwardly beyond the outer diameter of wrench head 102. This, too, may facilitate manipulation of plug socket 120 by hand, especially wherein the wrench remains secured to the plug socket.

Once the threads of drain plug 160 are disengaged from those of the oil pan (not shown), the user pulls plug socket 120 free of the oil pan along with drain plug 160, which is magnetically retained therein. After allowing the old oil to drain, the user re-installs the drain plug. Typically, the user will initially tighten the drain plug by hand since friction between the drain plug and oil pan are insufficient to allow ratcheting of wrench 100, and use the wrench to apply the final tightening torque. As before, hand tightening is accomplished via grip ring 150, with wrench 100 either engaging plug socket 120, or not. After the drain plug is properly seated and tightening by hand is no longer possible, the user applies the final torque with wrench 100. Lever 116 allows the user to select whether torque is applied in a clockwise or counter-clockwise direction for tightening or loosening of the drain plug.

Figure 9:
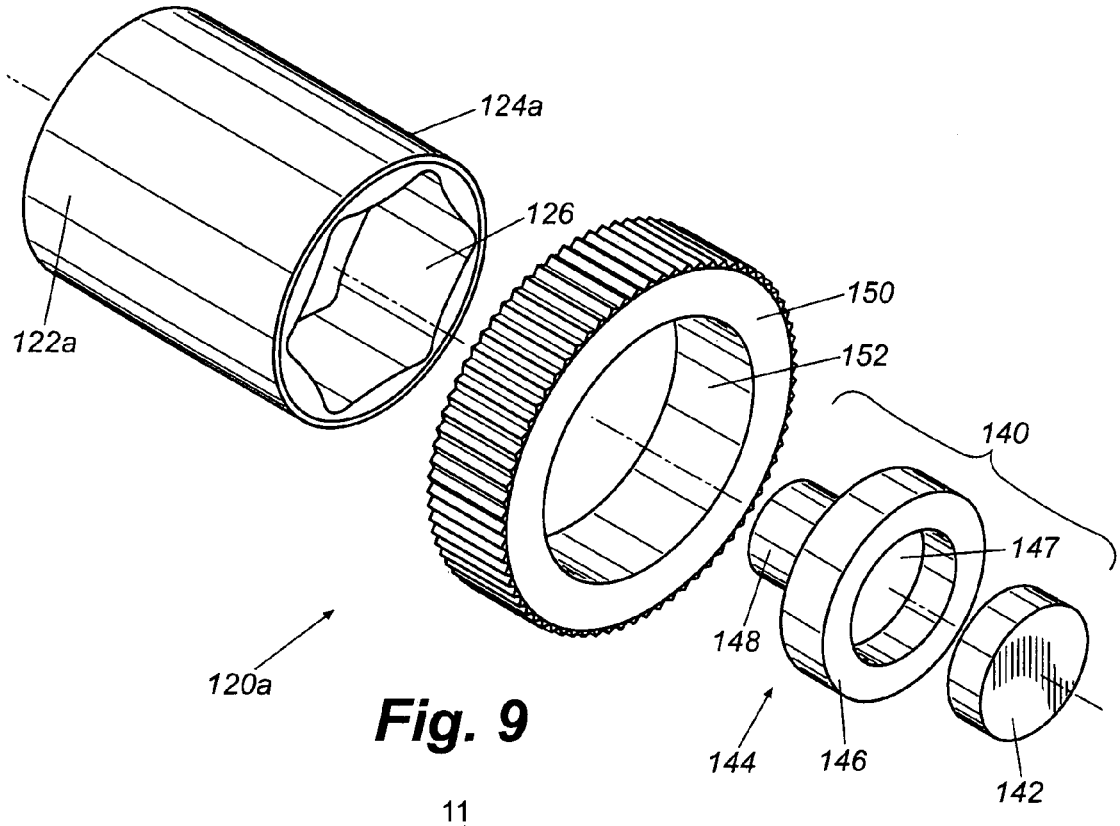
FIG. 9 is an exploded perspective view of an alternate embodiment of an oil drain plug socket in accordance with an embodiment of the present invention.
Figure 10:
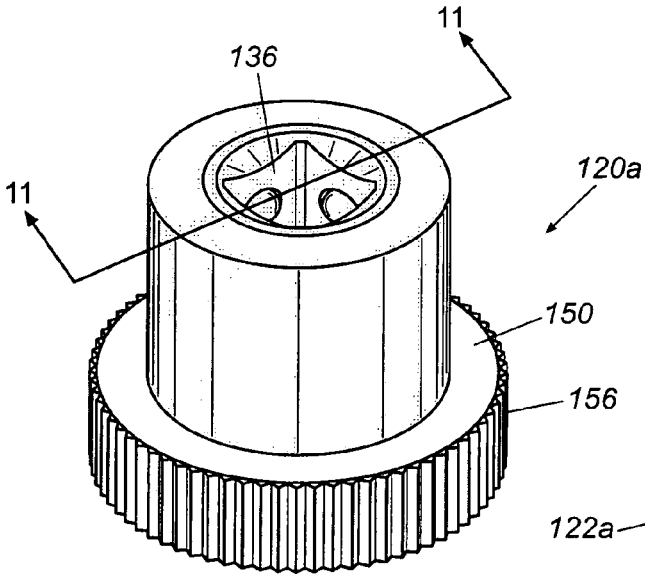
FIG. 10 is a perspective view of the oil drain plug socket as shown in FIG. 9.
Figure 11:
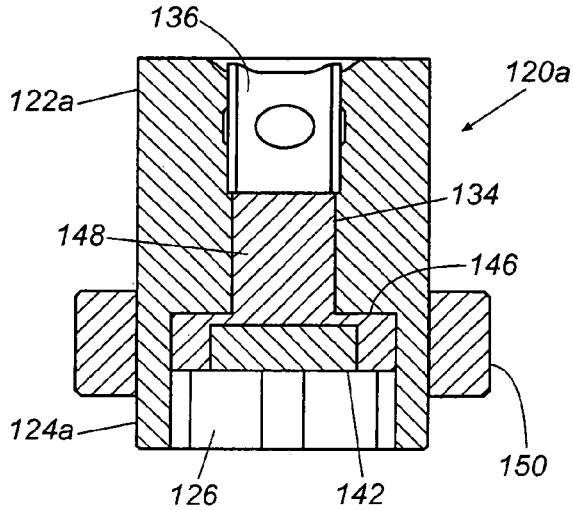
FIG. 11 is a cross-sectional side view of the oil drain plug socket as shown in FIG. 10, taken along line 11—11.

Referring now to FIGS. 9 through 11, an alternate embodiment of an oil drain plug socket 120*a* is shown in accordance with the present invention. Drain plug 120*a* is constructed similarly to drain plug 120 shown in FIGS. 2A and 2B, with the exception that the generally cylindrical rearward portion 122A does not include the previously described barrel portion. Rather, drain plug 120*a* has a square receiver 136 formed therein that is configured to receive a square drive tang (not shown) of a standard ratchet wrench 100*a*, as shown in FIGS. 12 and 13. Ratchet wrench 100*a* includes a detent mechanism (not shown) for releasably securing plug socket 120*a* to the drive tang. The detent mechanism is operated by depressing a button 121 on the head of ratchet wrench 100*a*.

While one or more preferred embodiments of the invention are described above, it should be appreciated by those skilled in the art that various modifications and variations can be made in the present invention without departing from the scope and spirit thereof. For example, the oil drain plug adapter can be used with non-ratcheting wrenches. As well, the correspondingly shaped ribs and depressions may be formed with various cross-sectional shapes, such as, but not limited to, triangular, square, rectangular, trapezoidal, etc. It is intended that the present invention cover such modifications and variations as come within the scope and spirit of the appended claims and their equivalents.

What is claimed is:

1. A ratchet wrench assembly comprising:

a. a wrench having a handle and a head at one end of said handle, said head defining an opening;

b. a ratchet ring disposed in said opening such that said ratchet ring rotates with respect to said head in a first direction and rotates with said head in a second direction, said ratchet ring defining a substantially cylindrical inner engaging surface having at least one rib projecting radially inward from said inner engaging surface; and c. a socket having a generally cylindrical first portion having an outer surface and defining a polygonally shaped bore therein, a grip ring non-rotatably disposed and axially fixed on said first portion outer surface and extending radially therefrom a distance substantially equal to or larger than an axial width of said grip ring; and a generally cylindrical second portion defining at least one depression in an outer surface thereof for releasably receiving said at least one ratchet ring rib therein when said second portion is inserted into said ratchet ring inner engaging surface.

2. The ratchet wrench assembly of claim 1, wherein said grip ring further includes a knurled outer surface and is press-fitted to said first portion outer surface.

3. The ratchet wrench assembly of claim 2, wherein said grip ring is composed of an inelastic material.

4. The ratchet wrench assembly of claim 3, wherein said inelastic material is aluminum.

5. The ratchet wrench assembly of claim 2, wherein an outer diameter of said grip ring is greater than an outer diameter of said wrench head such that said grip ring extends radially outward beyond an outer periphery of said wrench head.

6. The ratchet wrench assembly of claim 1, further comprising a magnetic insert secured in said polygonal bore.

7. The ratchet wrench assembly of claim 6, wherein said magnetic insert further comprises a magnet secured in a plug, wherein said plug is press-fitted in said polygonal bore.

8. The ratchet wrench assembly of claim 7, wherein said second portion further includes a square shaped bore for receiving a square shaped drive tang on said wrench head.

9. The ratchet wrench assembly of claim 7, wherein:

a. said socket includes an axial bore extending from said square shaped bore to said hexagonally shaped bore;

b. said plug includes a base for receiving said magnetic element and a stem extending therefrom; and c. said stem is received in said axial bore and said base is received in said polygonal bore.

10. The ratchet wrench assembly of claim 7, wherein said plug is composed of a non-metallic material.

11. The ratchet wrench assembly of claim 7, wherein:

a. said ratchet ring defines a plurality of said ribs, each said rib having a slot formed therein transverse to an axis of said ratcheting ring, said ratchet ring slots aligning with each other to form a first annular groove;

b. said socket second portion defines a second annular groove in said second portion outer surface that is positioned to align with said ratchet ring first annular groove when said second portion is inserted into said ratchet ring inner engaging surface; and c. a ring member is received in said first and said second annular grooves so as to releasably retain said adapter in the axial direction in said ratchet ring.

12. A socket for use with a ratchet wrench, said socket comprising:

a. a longitudinal axis;

b. a second portion defining a plurality of depressions axially aligned with said longitudinal axis in an outer surface thereof, said second portion being releasably received by the ratchet wrench;

c. a generally cylindrical first portion including an outer surface and defining a polygonal bore therein;

d. a non-integrally formed grip ring disposed on and extending radially from said first portion outer surface a distance substantially equal to or larger than an axial width of said grip ring, said grip ring including a knurled outer surface; and e. a magnetic insert received in said polygonal bore.

13. The socket of claim 12, wherein said grip ring is secured to said second portion outer surface by a press-fit.

14. The socket of claim 13, wherein said magnetic insert includes a magnet received in an elastomeric plug, wherein said elastomeric plug is press-fitted into said polygonal bore.

15. The socket of claim 13, wherein said grip ring is constructed of aluminum.

16. A ratchet wrench assembly comprising:

a. a wrench having a handle and a head at one end of said handle, said head defining an opening;

b. a ratchet ring disposed in said opening such that said ratchet ring rotates with respect to said head in a first direction and is rotationally fixed to said head in an opposite second direction, said ratchet ring defining a substantially cylindrical inner engaging surface having a plurality of ribs projecting radially inward therefrom, each rib having a slot formed therein transverse to an axis of said ratchet ring, said ratchet ring slots aligning with each other to form a first annular groove;

c. a ring member received in said first annular groove;

d. a socket having an axial bore formed therethrough, a first generally cylindrical portion including an outer surface and defining a hexagonal bore therein, an inelastic grip ring non-rotatably disposed and axially fixed on said first portion outer surface and extending radially therefrom, said grip ring being press-fitted to said first portion outer surface and including a knurled outer surface, a second portion defining a plurality of depressions in an outer surface thereof for releasably receiving said ratchet ring ribs therein when said second portion is inserted into said ratchet ring inner engaging surface, said second portion outer surface defining a second annular groove that is positioned to align with said ratchet ring first annular groove and releasably receive said ring member when said second portion is inserted into said ratchet ring inner engaging surface; and e. a magnetic insert having a plug including a base and a stem extending therefrom, said stem being received in said axial bore and a magnet received in said base, said bore being received in said hexagonal bore.

* * * * *